US008153876B2

(12) United States Patent
Krishnamurthy

(10) Patent No.: US 8,153,876 B2
(45) Date of Patent: Apr. 10, 2012

(54) SYSTEMS AND METHODS OF STRETCHING AND TUNING DRUMHEADS

(76) Inventor: Rohan Krishnamurthy, Rochester, NY (US)

( * ) Notice: Subject to any disclaimer, the term of this patent is extended or adjusted under 35 U.S.C. 154(b) by 106 days.

(21) Appl. No.: 12/781,363

(22) Filed: May 17, 2010

(65) Prior Publication Data

US 2010/0300261 A1 Dec. 2, 2010

Related U.S. Application Data

(60) Provisional application No. 61/217,451, filed on Jun. 1, 2009.

(51) Int. Cl.
*G10D 13/02* (2006.01)

(52) U.S. Cl. ..... 84/413; 84/411 R; 84/411 A

(58) Field of Classification Search ..... 84/413
See application file for complete search history.

(56) References Cited

U.S. PATENT DOCUMENTS

| | | | | | |
|---|---|---|---|---|---|
| 387,023 | A * | 7/1888 | Van Zandt | 84/411 R |
| 1,165,666 | A * | 12/1915 | Gunet | 84/413 |
| 2,204,987 | A * | 6/1940 | Gussak | 84/412 |
| 2,837,002 | A * | 6/1958 | Susser | 84/170 |
| 3,139,783 | A * | 7/1964 | Grant et al. | 84/411 R |
| 3,185,013 | A * | 5/1965 | Gussak | 84/411 R |
| 3,923,406 | A * | 12/1975 | Iritz | 403/43 |
| 4,077,297 | A * | 3/1978 | Woodson | 84/411 R |
| 5,419,430 | A * | 5/1995 | Wilson et al. | 206/216 |
| 6,040,513 | A * | 3/2000 | Belli | 84/411 R |
| 7,825,318 | B2 * | 11/2010 | Ito | 84/411 R |
| 2003/0061929 | A1 * | 4/2003 | Dye et al. | 84/411 R |
| 2004/0134333 | A1 * | 7/2004 | May | 84/413 |
| 2006/0174749 | A1 * | 8/2006 | Lerner | 84/419 |
| 2008/0168886 | A1 * | 7/2008 | Neumayer et al. | 84/411 R |

* cited by examiner

*Primary Examiner* — Jeffrey Donels
*Assistant Examiner* — Christopher Uhlir

(57) ABSTRACT

A system for stretching and tuning a drumhead includes a plurality of bolts each provided with a threaded shank and at least one associated nut threaded thereon. Each bolt is secured circumferentially and substantially equi-angularly about the periphery of the drum shell. The system includes a flexible, elongate member that is woven alternatively between the drumhead and each of the bolts until the elongate member is taut. Thereafter, the bolt shanks may be rotated relative to the bolt nuts so as to pull the elongate member into a more taut tension, whereby the condition of the drumhead increases. A drum including the system, a kit for implementing the system, and a method of implementing the system are also disclosed.

21 Claims, 5 Drawing Sheets

SYSTEMS AND METHODS OF STRETCHING AND TUNING DRUMHEADS

CROSS-REFERENCE TO RELATED APPLICATIONS

The present application is a non-provisional patent application of, and claims priority to and the benefit of, U.S. Provisional Patent Application No. 61/217,451, filed Jun. 1, 2009 entitled "SYSTEMS AND METHODS OF STRETCHING AND TUNING DRUMHEADS", which is hereby incorporated by reference in its entirety.

FIELD OF THE INVENTION

The present invention relates generally to a system, a kit, and a method for tensioning drumheads, which are membranes stretched over one or both of the open ends of a drum shell. A drumhead is struck with sticks, mallets, or hands, causing the drumhead to vibrate and to produce an audible sound that resonates through the drum. The present invention also relates to a drum including the tensioning system.

BACKGROUND OF THE INVENTION

Drumheads were made originally from animal skin and were stretched across at least one open end or mouth of a drum shell and secured in a taut condition over the mouth of the drum shell by wrapping vines or leather lace tightly around the periphery of the drum shell, thereby compressing and clamping the animal skin against the periphery of the drum shell and maintaining the animal skin in a taut condition over the mouth of the drum shell. With use, the membrane both becomes worn, and becomes loosened from its taut condition as it is pulled away from the clamping forces of the vine or leather lace. Consequently, the animal skin often needs to be replaced and to be re-stretched in a relatively more taut condition.

By stretching an animal skin over one mouth of the drum shell at a certain tension, a certain pitch is produced upon striking the animal skin, and by placing another animal skin over the other mouth of the drum shell, a different pitch may be produced from striking that other animal skin. By striking both membranes, two pitches may be selectively employed, thereby permitting more sophisticated sounds to be produced by the drum.

In another aspect, each one of a plurality of drums may have different tensioning of the drumheads, such that an ensemble of drums can produce an elaborate variations of pitches in the sounds created by the drum ensemble.

Drumheads have been more recently fashioned of materials other than animal skin. In the mid-1900's, plastic drumheads were made from polyester that were cheaper, more durable, and less sensitive to weather than animal skins. Recently, drumheads have been fashioned of other plastic materials, such as mylar, and aramid fiber, such as kevlar.

Mechanisms for producing tension in the drumhead have also become more sophisticated. For example, a wooden or metal hoop or rim may be placed over the membrane such the membrane is squeezed between the inner periphery of the rim and the outer periphery of the drum shell. Thereafter, the rim may be moved forcefully away from the mouth of the drum shell such as with turnbuckle assemblies whereby the rim translates along the outer periphery of the drum shell and pulls the membrane along with it. Due to the compression of the membrane between the rim and the outer periphery of the drum shell, the membrane is stretched tighter across the mouth of the drum shell. The turnbuckles are usually circumferentially arranged in an equi-angular array about the outer periphery of the drum shell so that the rim may be drawn substantially evenly along the drum shell and so that the tension in the drumhead is fairly evenly, uniformly maintained across the mouth of the drum shell. In a reverse manner, the turnbuckles may be rotated so as to reduce or relieve the tension on the membrane or drumhead.

It is important that the drumhead tensioning system be able to readily change the tension of the drumhead in order to produce a selected pitch, and also that the tension be fairly uniformly maintained across the drumhead, so that the pitch is essentially constant when striking the drumhead at any particular spot or region of the drumhead. Also, such a tensioning system should permit quick and easy replacement of a drumhead.

The present invention was developed with particular reference to an ancient, pitched, hand drum known as the mridangam, which was developed predominantly in southern India. One end of the mridangam drum possesses a relatively high pitched tonal drumhead, and the other end possesses a relatively low pitched bass drumhead. Each drumhead typically possesses sixteen apertures spaced equi-angularly along the circumference thereof, and a very long leather thong or strap is laced alternatively through an aperture in each of the two drumheads and is then tightened thereby to stretch each drumhead simultaneously. By shortening the effective length of the leather strap, the drumheads are more highly tensioned, and by lengthening the leather strap, the tension in the drumheads is lessened, whereby the pitch of each drumhead may be selectively, though interdependently, tuned.

Some of the problems associated with the foregoing drumhead tensioning system for a mridangam are that both drumheads are tuned interdependently of each other, and not independently of each other, thereby tending to restrict the range of pitches that may be obtained from the drumheads. Perhaps an even greater challenge posed by this system is the gradual slackening of tension (and corresponding pitch) applied to the drumheads over time, which is exacerbated in colder climates due to the nature of the leather strapping. Finally, the traditional tuning system makes convenient and efficient replacement of drumheads by the practitioner a virtually impossible task.

SUMMARY OF THE INVENTION

The present invention relates in one aspect to a system for stretching and tuning a drumhead. The system includes a plurality of bolts each provided with a threaded shank and at least one associated nut threaded thereon. Each bolt is secured circumferentially and substantially equi-angularly about the periphery of the drum shell. The system includes a flexible, elongate member that is woven alternatively between the drumhead and each of the bolts until the elongate member is taut. Thereafter, the bolt shanks may be rotated relative to the bolt nuts so as to pull the elongate member into a more taut condition, whereby the tension of the drumhead increases. A drum including the system, a kit for implementing the system, and a method of implementing the system are also disclosed.

BRIEF DESCRIPTION OF THE DRAWINGS

The invention will be described with reference to the accompanying drawings, wherein.

DESCRIPTION OF A PREFERRED EMBODIMENT

Figure 1:
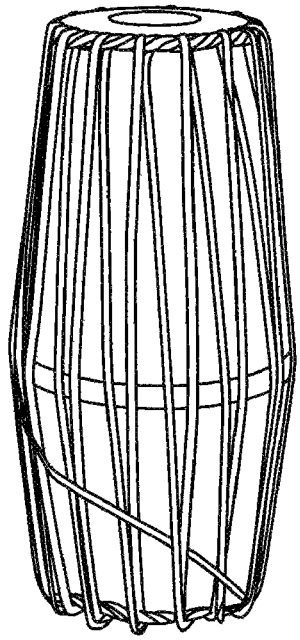
FIG.1 Prior Art
FIG. 1 is a perspective view of a traditional, conventional prior art mridangam showing the tonal and bass drumheads stretched over the mouths of the drum shell by means of an leather strap interconnecting the drumheads.

The present invention will be described with reference to the accompanying drawings wherein like reference numerals refer to the same item. There shown in FIG. 1 a conventional, traditional, prior art mridangam. Although the present invention will be described with particular reference to a mridangam type drum, it will be appreciated that the invention is also applicable to a wide variety of other drums, including other Indian drums such as the tabla, pakhawaj, dhol, dholak, tavil, and naal, as well as other drums such as congas and bongos, and a wide variety of other drums. For the sake of simplicity, the present invention will be described with particular reference to the mridangam, however, the invention should not be considered as being limited or restricted to the mridangam.

Although early mridangams included a drum shell fashioned of a hardened clay, over the years, the mridangam drum shell has been fashioned of different kinds of wood. Today, the mridangam drum shell is typically constructed from the wood of the jackfruit tree. The drum shell of a conventional mridangam is typically about one-inch thick.

Figure 2:
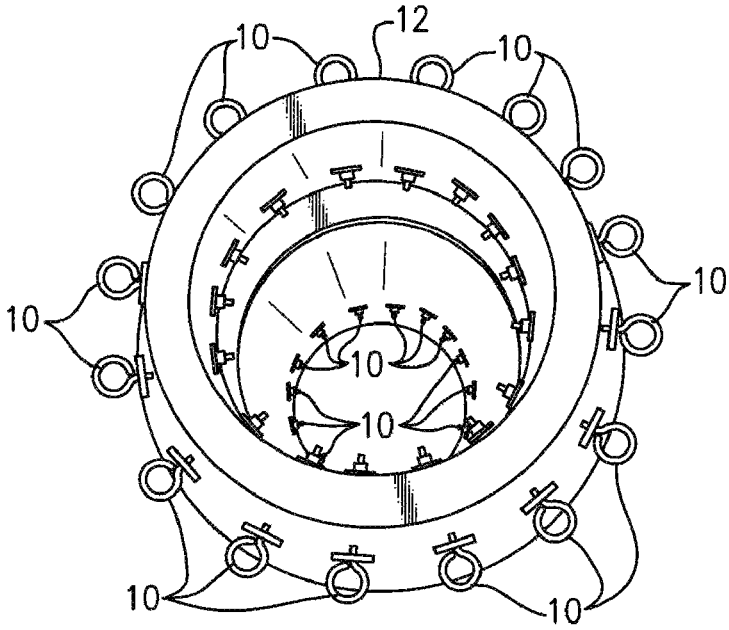
FIG. 2 is a top view of the wooden shell of a traditional mridangam showing an upper circumferential row and a lower circumferential row of eye bolts extending through the drum shell.

As can be appreciated from reviewing FIGS. 1 and 2, the mridangam drum shell possesses a generally tubular configuration about a central axis, and a central, hollow, substantially cylindrical or barrel-shaped cavity extending substantially along the central axis from one longitudinal end thereof to the other longitudinal end thereof. As especially shown in FIGS. 2, 5, 7, and 9, each of the longitudinal ends possesses a substantially circular inner edge, and a substantially circular outer edge concentrically arranged about the inner edge. Each longitudinal end may be considered a mouth, and the edges of the drum shell forming the mouth may be considered a substantially circular lip. At one longitudinal end of the drum shell, the lip possesses a relatively small diameter, which is the tonal end of the drum, and the lip at the other end of the drum shell possesses a relatively large diameter, which is the bass end of the drum.

Each mouth of the drum shell is covered with a variety of leather membranes made of goat, cow, and buffalo skin. The thickness of each membrane is substantially uniform, however, the selection and thickness of the leather membranes covering each mouth differs to allow for the production of both bass and treble sounds from the same drum. The leather membranes are stretched over an associated mouth of the drum shell and over the lip forming such mouth. The circumferential edge of each leather membrane is punctured with a series of traditionally sixteen apertures equi-angularly arranged such that the apertures are disposed circumferentially outside of the associated lip of the drum shell. A leather strap, such as a buffalo thong, extends alternately between an aperture in one leather membrane covering the tonal end, and an aperture in the leather membrane covering the bass end of the drumhead, creating a woven figuration as shown in FIG. 1.

Typically, the leather membrane covering the smaller, tonal end is anointed in the center with a black disc made from a mixture of rice flour, iron oxide powder, and starch. The mixture of the flour, powder, and starch is colored black, and initially is in the form of a paste. The black disc fashioned of the hardened paste gives the mridangam its distinct tonal timbre.

The mridangam is tuned by changing the tension in the leather membranes stretched across each mouth, which in turn is accomplished by varying the tension in the leather strap woven around the outside of the drum shell. Because the leather strap is woven between both membranes, adjusting the tension on the strap causes the tensions in both leather membranes to be concomitantly changed. Thus, the tuning of each membrane is dependent on the tensioning of the other membrane—a drawback of the existing, conventional tensioning system for mridangam drums. Moreover, the tension should be uniform and balanced at all points along the circumference of the leather membrane in order for the drumhead to resonate perfectly. Consequently, providing a higher tension in one portion of the leather strap may produce an imbalanced tension in each associated drumhead, which further complicates proper tuning of each mridangam drumhead.

It will also be appreciated that the replacement of even one of the drumheads of the mridangam requires an extremely laborious effort in unweaving the leather strap, then re-weaving the leather strap through the holes in the replacement drumheads, and then tightening the leather strap uniformly, circumferentially about each of the mouths of the drum shell.

Figure 3:
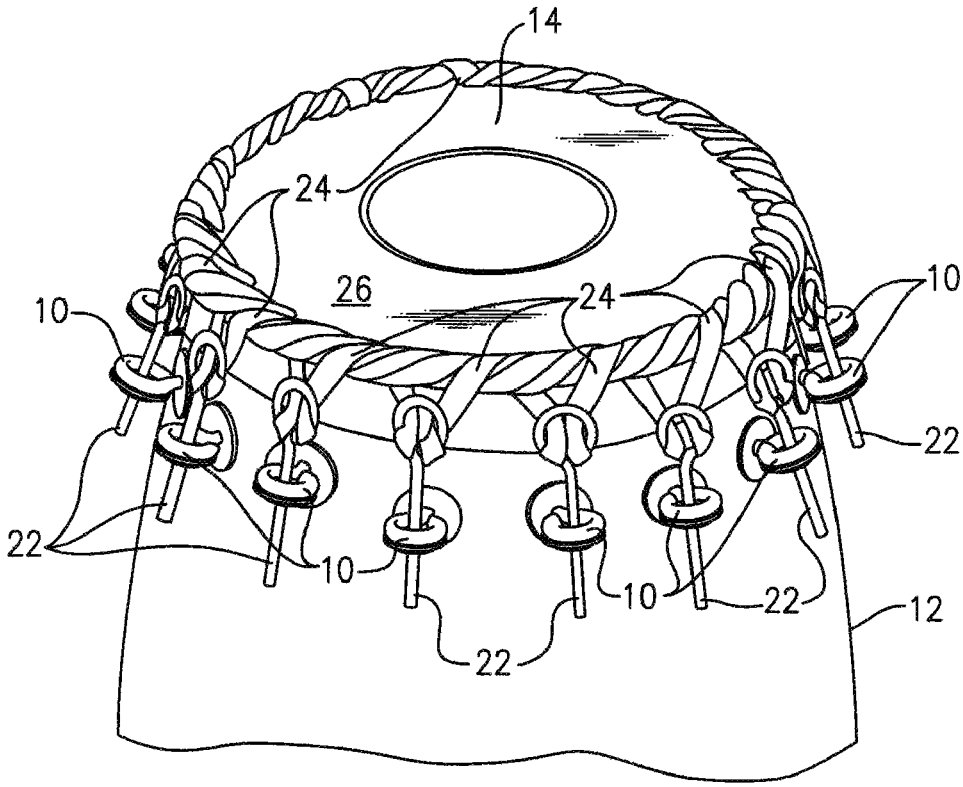
FIG. 3 is a perspective view of the upper portion of the mridangam drum shell shown in FIG. 2 including a drumhead and including a flat nylon web interconnecting the drumhead with each of a second series of eye bolts, the shanks of which extend through the eyes of the eye bolts shown in FIG. 2.

There shown in FIGS. 2 and 3 a tensioning system in accordance with one embodiment of the present invention.

Figure 4:
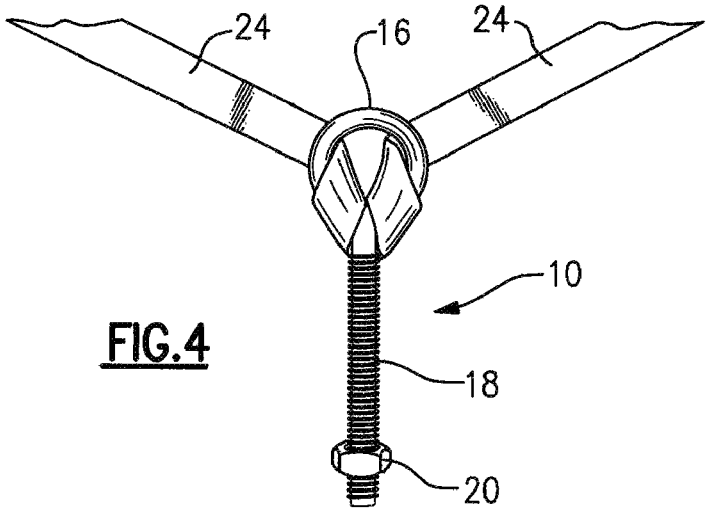
FIG. 4 is a plan view of single eye bolt showing a preferred manner of weaving the flat nylon web shown in FIG. 3 through the eye portion of each eye bolt.

The system includes a series of eye bolts 10 secured to and radially through the mridangam drum shell 12 about 3-6 inches from an associated mouth of the drum shell 12. As shown in FIG. 2, there are two sets of sixteen such eye bolts 10 circumferentially and equi-angularly arranged in two rows around and extending radially through the drum shell 12. It will be appreciated that the number of the eye bolts 10 in each row corresponds with the sixteen holes traditionally punctured along the circumference of the leather membrane 14 of a mridangam drumhead. It should be further appreciated that the number of eye bolts 10 as well as the number of holes in the drumhead may be selectively chosen and may be different from the traditional sixteen-hole arrangement. As shown in FIGS. 2, 3, and 4, each of the eye bolts 10 possesses a relatively circular eye portion 16, and a threaded shank section or shaft 18 extending through the wall of the drum shell 12. Each eye bolt 10 further includes a nut 20 that is threadably, selectively secured about the threaded shaft 18 thereof. In order to minimize the possibility that the eye bolt 10 will wear away a surrounding portion of the drum shell and thereby induce wobbling of the eye bolt, a washer may be interposed between each eye portion 18 of an eye bolt 10 and the outer peripheral surface of the drum shell 12, and another washer may be interposed between the nut 20 and the inner peripheral surface of the drum shell 12. Each nut 20 is then tightened so that the eye portion 16 of each eye bolt 10 compressly engages the associated washer interposed between the eye portion 16 of the eye bolt 10 and the outer peripheral surface of the drum shell 12, whereby such washer is compressly engaged against the outer peripheral surface of the drum shell 12. Likewise, each nut 20 compressly engages the washer interposed between the nut 20 and the inner peripheral surface of the drum shell 12, whereby such washer is compressly engaged against the inner peripheral surface of the drum shell 12.

As shown in FIG. 3, the system includes a second series of eye bolts 22 each of which eye bolts 22 correspondingly extends through an associated one of the eye portion 16 of the first series of eye bolts 10 extending through the drum shell 12. Each of the second series of eye bolts 22 includes an eye portion, a threaded shaft, and a nut threadably mounted on the threaded shaft, which may be essentially identical to the eye bolts 10 of the first series. Each eye portion of the second series of eye bolts 22 extends toward the mouth of the associated mouth of the drum shell 12. In the second series of eye bolts 22, an associated washer is preferably interposed between a nut and the eye portion of each eye bolt of the first series of eye bolts 10 extending through the drum shell 12.

A continuous, flexible, substantially inelastic, flat nylon webbing 24 is interwoven alternatively through each hole along the circumference of the leather drumhead 26 and the eye of each bolt 22 in the second series of eye bolts 22. Although the webbing 24 may extend through the eye of each eye bolt 22 in a simple loop, or in another fashion, preferably the webbing extends into the eye portion 16, around a portion of the shaft 18, and back through the eye portion 16 as best shown in FIG. 4. One end of the webbing 24 is tied in a knot before weaving the other, non-knotted end of the webbing 24 through the sixteen apertures in the leather membrane 26 and the eye portions of the second series of eye bolts 22, and when the interconnecting, weaving process is completed, then another knot is tied in the webbing 24 so that the knot will not retract back through an aperture or an eye of an eye bolt 22 and will maintain the webbing 24 in a relatively taut condition. Thereafter, the nuts 20 of each eye bolt 22 in the second series of eye bolts 22 may be rotated with respect to the associated eye bolt threaded shaft to move the eye portion of the eye bolt 22 in the second series eye bolts 22 away from the drumhead 26 so that the drumhead 26 is stretched and tightened. The drumhead 26 can be tightened in this fashion until the appropriate, selected pitch of the drumhead 26 is obtained.

It will be appreciated that finer tuning of the drumhead 26 may be accomplished by tightening or loosening by appropriate rotation of a nut 20 associated with a selected one or ones of the eye bolts 22 in the second series of eye bolts 22 so that tension throughout the drumhead 26 is uniform, thereby creating an ideal resonance. In comparison, fine tuning of the conventional mridangam involves tapping the circumference of the leather membranes with a stone and peg to shift the drumhead and correspondingly vary the tension of the straps on the drumhead. This technique, which is part of traditional mridangam education, can also be successfully employed with the new tuning system. It should also be appreciated that, when comparing the labor involved in replacing and tuning a drumhead 26 in a conventional mridangam such as that shown in FIG. 1, the embodiment of the invention shown in FIGS. 2 and 3 permits a much easier, quicker replacement and tuning of the drumhead 26 that can be completed by the practitioners themselves instead of requiring the expertise of a mridangam artisan usually located in Southern India. It will also be appreciated that the tuning of each drumhead 26 of the mridangam may be independently attained in accordance with the embodiment of the invention shown in FIGS. 2 and 3.

Although the eye portions in the second series of eye bolts 12 described in reference to FIGS. 2 and 3 possess a circular configuration, the invention contemplates that other configurations may be advantageously utilized as well, such as an eye having a triangular configuration, or the eye may be replaced by a configuration. It should also be appreciated that instead of a single nut threaded onto an associated threaded shaft of an eye bolt, two or more nuts may be threaded onto a single shaft. Such multiple nuts help ensure that the threaded position of the nut on the shaft is maintained, and is not loosened. Also, the nut may be a standard square or hexangular nut or may be lock nut. Further, the threads of each eye bolt shaft are preferably fine so that the tension on the nylon webbing may be more finely and sensitively adjusted and so that the nut will be more securely maintained in a selected threaded position and will tend not to unwind or loosen.

Although in a preferred embodiment, a flat nylon webbing is utilized to interconnect an associated leather membrane with the eye portion of each eye bolt in the second series of eye bolts, the webbing may instead comprise a nylon rope, a metal wire, a metal cable, a plastic cord, a string, or another strong, flexible, elongate member. Preferably, such elongate members are very flexible, and preferably relatively or essentially inextensible along their length.

Figure 5:
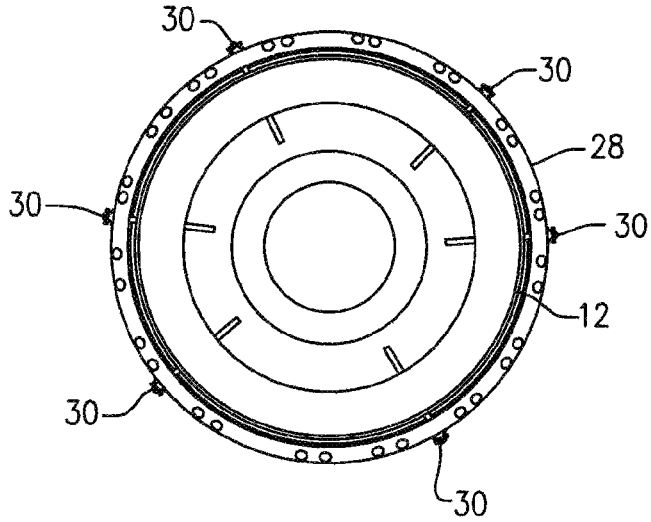
FIG. 5 is a top view of a conventional rmidangam drum shell possessing a tubular metal ring or collar spaced slightly from and extending around the outer periphery of the drum shell and secured to the drum shell by a series of screws or bolts.
Figure 6:
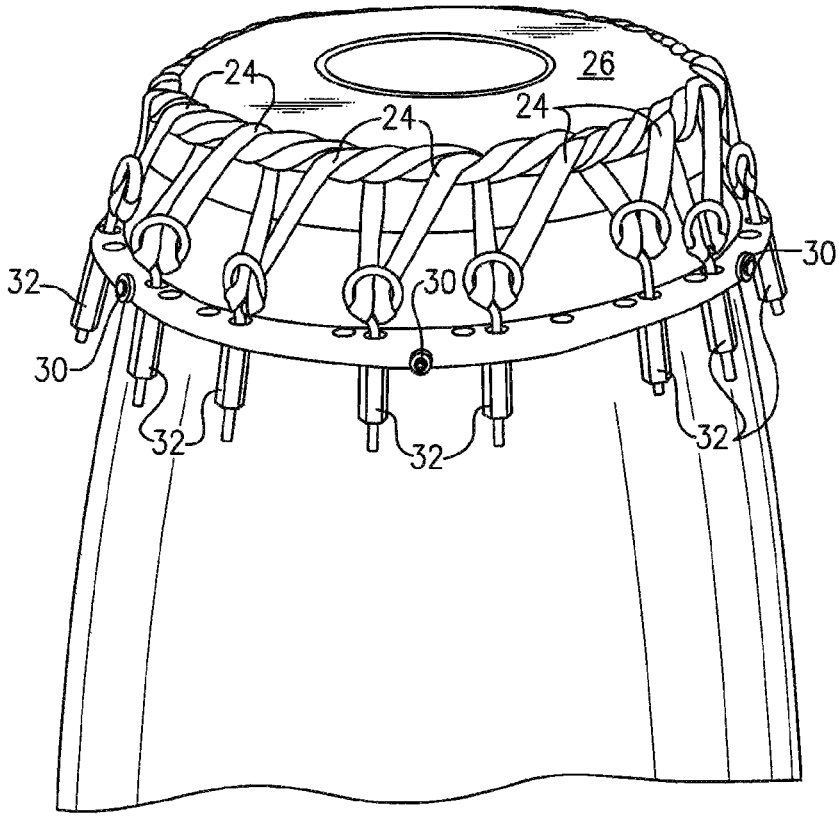
FIG. 6 is a perspective view of the upper portion of the mridangam drum shell shown in FIG. 5 including a drumhead and a series of eye bolts extending through the tubular ring or collar shown in FIG. 5 with a flat nylon web such as that shown in FIGS. 3 and 4 interconnecting the drumhead and the eye portion in each eye bolt.

Another embodiment of the present invention will be described with reference to FIGS. 4 and 5, which depict a tubular ring or collar 28 spaced equidistantly from the outer periphery of the drum shell 12 and circumferentially extending about the drum shell 12. Preferably the collar 28 is tubular, although it may be solid and may possess other than a circular-cross-section, and preferably the collar 28 is fashioned of a strong metal such as aluminum. A series of holes preferably equi-angularly arrayed about the collar are drilled radially through the collar 28 and through the drumhead 12, as best shown in FIG. 4. A bolt or screw 30 may extend through each associated drill hole in order to secure the collar 28 in a selected longitudinal position with respect to the drum shell 12. Preferably, the collar 28 is disposed and arranged about 3-6 inches from the associated mouth of the drum shell 12. As shown in FIG. 6, a series of eye bolts 32 in all respects similar to the eye bolts 10 shown in FIG. 4 may extend through the ring or collar 28, and a nylon webbing 24 may interconnect the associated leather membrane 26 and the eye portion of each of the eye bolts 32, as best shown in FIG. 6. In this embodiment, there is less need to interpose a washer between the nut threaded onto each shank of each eye bolt 32 and the collar 28. Also, as shown in FIG. 6, the nut may comprise a relatively elongated nut for ease in manipulation.

Figure 7:
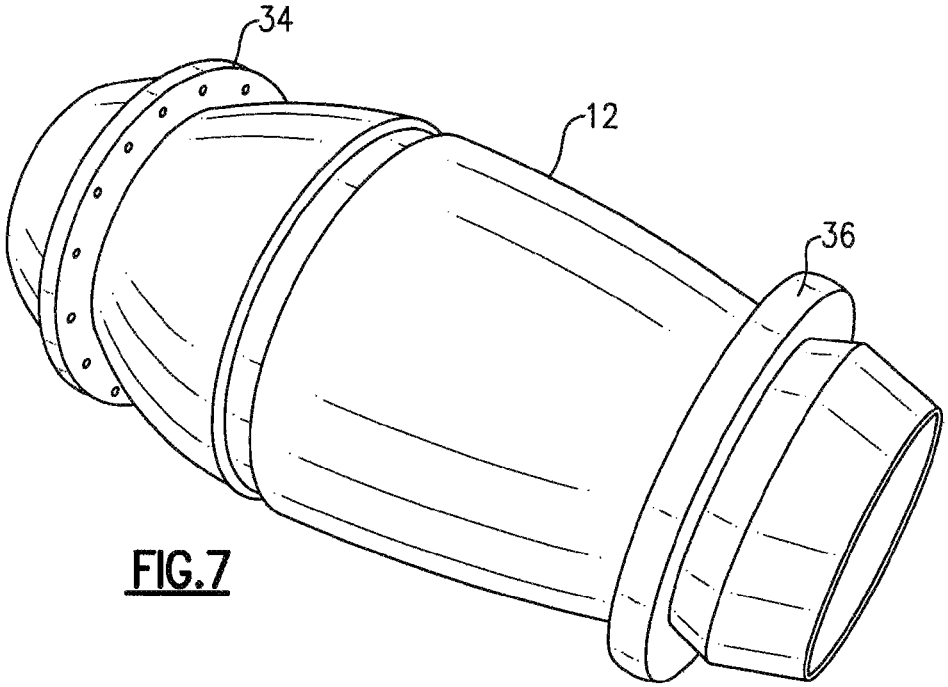
FIG. 7 is a perspective view of a mridangam drum shell depicting an upper collar and a lower collar circumferentially extending about the outer periphery of the drum shell near a respective mouth thereof, which collars are integrally formed of the same wooden material as the mridangam drum shell.
Figure 8:
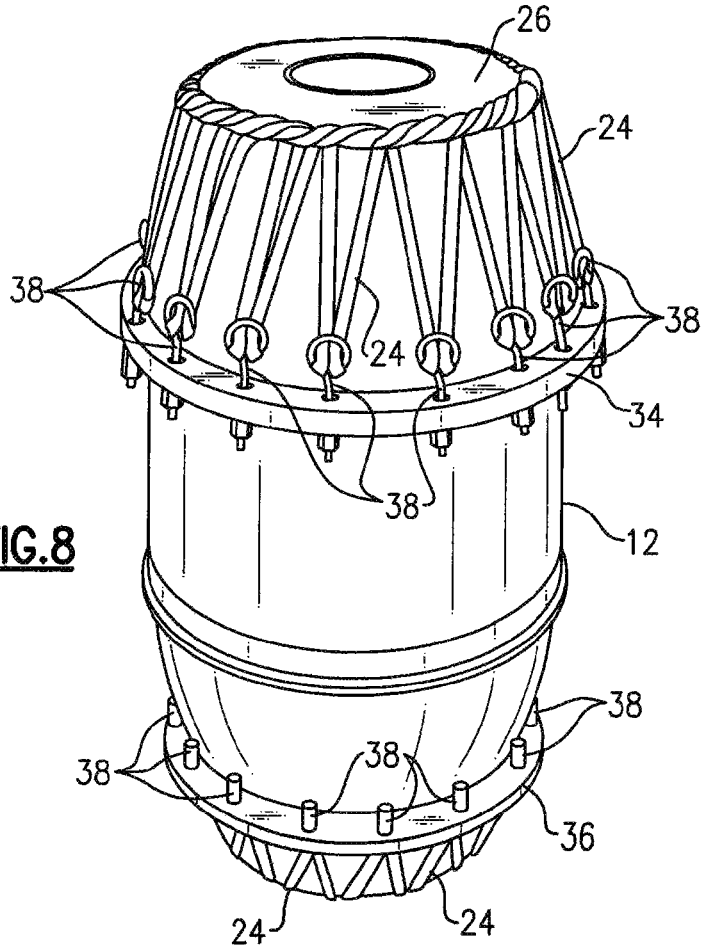
FIG. 8 is a perspective view of the drum shell shown in FIG. 7 depicting a series of eye bolts longitudinally extending through each of the collars and including a flat nylon web that interconnects each drumhead with the eye section of each of the eye bolts extending through an associated one of the collars.

In another embodiment of the present invention, instead of securing a tubular ring or collar about the outer periphery of the drum shell 12 near each mouth thereof, the drum shell 12 itself may possess an integrally formed collar 34, 36 disposed near each end thereof and extending circumferentially around the outer peripheral surface of the drum shell 12, as shown in FIGS. 7 and 8. In this embodiment, the collars 34, 36 are preferably spaced about six to ten inches from the associated mouth of the drum shell 12, but are also functional at other locations on the shell. In the embodiment shown in FIGS. 7 and 8, a series of eye bolts 38 in all respects similar to those shown in FIGS. 4 and 6 extend longitudinally through an associated one of the integrally fashioned collars 34, 36. As with the embodiment shown with FIG. 5, a flat nylon webbing may interconnect the leather membrane and the eyes of each of the eye bolts 38.

Figure 9:
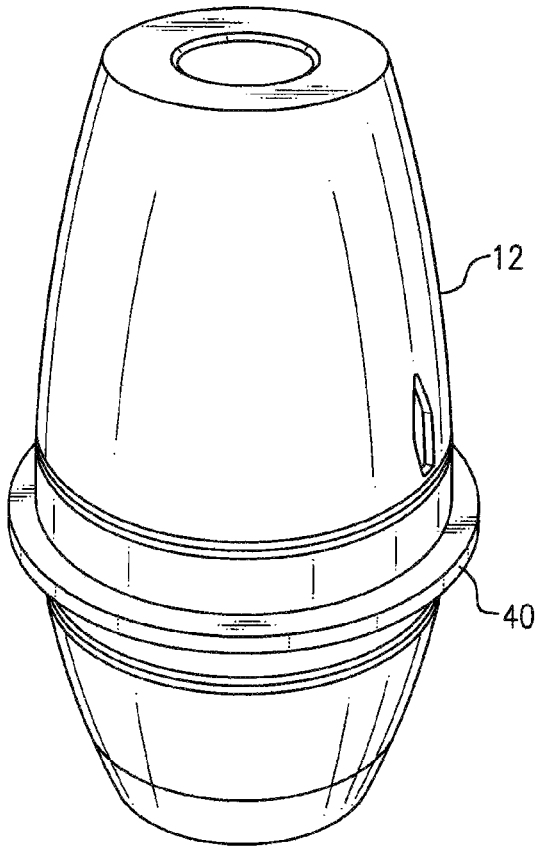
FIG. 9 is a perspective view of a mridangam drum shell depicting a single collar circumferentially extending about the outer periphery of the drum shell, which collar is integrally formed of the same wooden material as the mridangam drum shell.
Figure 10:
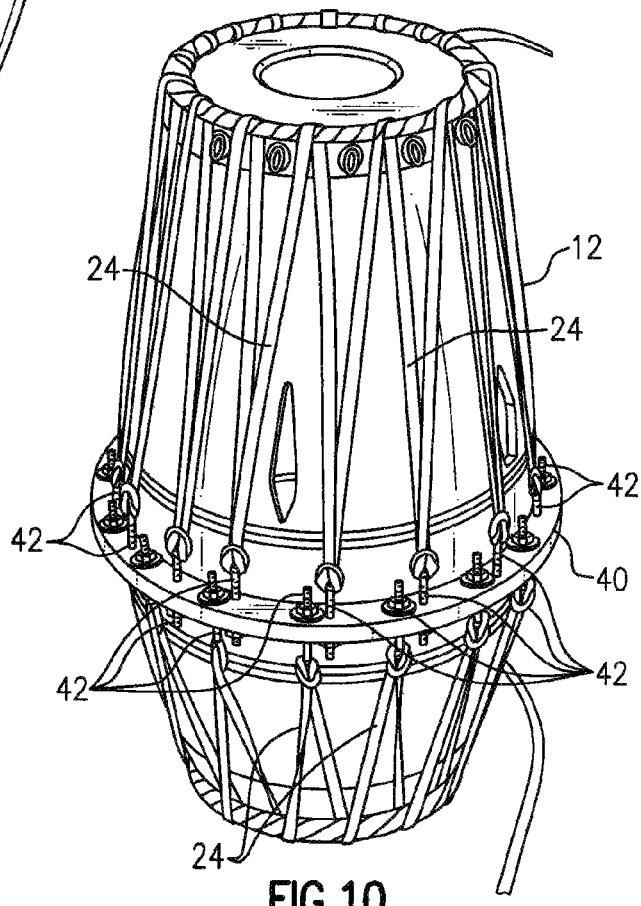
FIG. 10 is a perspective view of the drum shell shown in FIG. 9 depicting a series of eye bolts longitudinally extending through the collar in alternating longitudinal directions and including a flat nylon web interconnecting an associated drumhead with the eye section of the eye bolts extending through the collar and toward that drumhead.

Another embodiment of the present invention as shown in FIGS. 9 and 10, employs a drum shell possessing a single integrally fashioned collar 40 spaced about ten to eighteen inches from one mouth thereof. The embodiment of the invention shown in FIGS. 9 and 10 includes a series of eye bolts 42 and nylon webbing 24 in all respects similar to those shown in FIG. 8, with the eye bolts 42 all extending through the same, single integrally formed collar 40, but with the eye bolts 42 alternatively projecting and extending in different longitudinal directions, as depicted best in FIG. 10.

It will be appreciated by those skilled in the art that the present invention provides several distinctive advantages over a conventional mridangam, including independent tuning of the drumheads, pitch maintenance and range, and ease of drumhead replacement. Moreover, the use of a webbing woven between an associated drumhead and a series of eye bolts retains the visual aesthetic of the traditional mridangam design. The present invention is relatively inexpensive to manufacture, and many embodiments of the present invention are capable of being used to retrofit existing, conventional mridangams. It has been found that the present invention creates a selectable range of pitches in each drumhead that are nearly plus or minus four to five whole steps of pitch range, as contrasted with the plus or minus one whole step of pitch range associated with a traditional mridangam.

Thus, while various embodiments of the present invention have been described herein, it will be appreciated that the invention includes embodiments other than those specifically illustrated or described and that changes in the form and arrangement of parts and the specific manner of practicing the invention may be varied without departing from the nature or scope of the invention. Consequently, the invention may be practiced otherwise than is specifically described above.

I claim:

1. A drum comprising:

a drum shell substantially concentrically arranged about a central axis and possessing a substantially hollow cavity extending along the central axis thereof, said shell having at least one substantially open end defined by an associated, substantially circular lip;

a membrane extending over said at least one open end and said lip; and means for stretching and tuning said membrane.

2. The drum according to claim 1 wherein said drum shell possesses an outer periphery and wherein said stretching and tuning means includes a plurality of bolts circumferentially disposed in a substantially equi-angular array about the outer periphery of said shell and connected to said shell.

3. The drum according to claim 2 wherein said stretching and tuning means further includes a flexible, elongate member interconnecting said membrane and each of said plurality of bolts.

4. A drum according to claim 3 wherein said elongate member is selected from the group consisting of a leather thong, a lace, a flat nylon webbing, a nylon rope, a metal wire, a metal cable, a plastic cord, and a string.

5. A drum according to claim 2 wherein a collar is circumferentially attached to the outer periphery of the drum shell and wherein each of said plurality of bolts extends through said collar.

6. A drum according to claim 5 wherein said collar is integrally formed with said drum shell.

7. A drum according to claim 5 wherein said collar consists essentially of a material different from said drum shell and wherein said collar is mounted to said drum shell and circumferentially around said drum shell.

8. A drum according to claim 3 wherein each of said plurality of bolts comprises an eye bolt and wherein said elongate member extends through the eye of each of said plurality of bolts.

9. A drum according to claim 8 wherein said eye bolt possesses an eye hole configuration selected from the group consisting of substantially circular and substantially triangular.

10. A drum according to claim 1 wherein said shell has two substantially open, opposing longitudinal ends, each end defined by an associated, substantially circular lip, wherein said membrane extends over a first one of said open longitudinal ends and said lip associated with said first one of said open longitudinal ends, said drum further comprising:

a drumhead extending over a second one of said open longitudinal ends and said lip associated with said second one of said open longitudinal ends; and means for stretching and tuning said drumhead acting independently of said means for stretching and tuning said membrane.

11. A drum according to claim 10 wherein said means for stretching and tuning said membrane includes a first flexible, elongate, substantially inextensible member and wherein said means for stretching and tuning said drumhead includes a second flexible, elongate, substantially inextensible member.

12. A drum according to claim 11 wherein said shell includes an outer periphery and wherein said means for stretching and tuning said membrane further includes a first series of bolts circumferentially disposed in a substantially equiangular array about the outer periphery of said shell and connected to said shell and wherein said means for stretching and tuning said drumhead further includes a second series of bolts circumferentially disposed in a substantially equiangular array about the outer periphery of said shell and connected to said shell.

13. A drum according to claim 12 wherein said drum shell includes at least one collar integrally formed with said drum shell and wherein said first series of bolts and said second series of bolts each extend through said at least one collar.

14. A drum according to claim 13 including two of said collars longitudinally spaced from each other and disposed on the outer periphery of said drum shell, wherein said first series of bolts extends through one of said collars and said second series of bolts extends through the other one of said collars.

15. A drum according to claim 12 wherein said first member alternatingly extends directly between the bolts in said first series of bolts and said membrane and wherein said second member alternatingly extends directly between the bolts in said second series of bolts and said drumhead.

16. A drum according to claim 15 wherein substantially each of said bolts in said first series of bolts comprises an eye bolt possessing an eye portion and a shaft portion and substantially each of said bolts in said second series of bolts comprises an eye bolt possessing an eye portion and a shaft portion and wherein said first member extends into the eye portion of each eye bolt, around the shaft portion of each eye bolt, and back through the eye portion of each eye bolt in the first series of bolts and wherein said second member extends into the eye portion of each eye bolt, around the shaft portion of each eye bolt, and back through the eye portion of each eye bolt in the second series of bolts.

17. A kit for stretching and tuning a drumhead membrane of a drum possessing an outer periphery, the kit comprising:

a plurality of bolts adapted to be circumferentially and substantially equiangularly arranged and connected to the outer periphery of said drum; and a flexible, elongate member adapted to directly interconnect said membrane and each of said plurality of bolts, said elongate member being selected of a length sufficient to interconnect in an alternating fashion a different one of said plurality of bolts and said membrane.

18. A kit according to claim 17 wherein said plurality of bolts includes at least twelve bolts.

19. A method of stretching and tuning a drumhead of drum including a drum shell concentrically arranged about a central axis and possessing a substantially hollow cavity extending along the central axis thereof, said shell possessing an outer periphery and having at least one substantially open end defined by an associated, substantially circular lip, said drum further including a membrane extending over said at least one open end and said lip, the method comprising:

(a) providing a plurality of bolts, each bolt provided with a threaded shank and at least one associated nut threaded thereon;

(b) providing a flexible, elongate member;

(c) securing each of said plurality of bolts substantially circumferentially and substantially equiangularly about the outer periphery of said shell;

(d) weaving said elongate member alternatively between and directly interconnecting said membrane and each of said plurality of bolts until said elongate member is taut; and (e) rotating the shank of at least one of said plurality of bolts with respect to the associated nut threaded thereon such that the shank translates and pulls said elongate member whereby said elongate member becomes more taut.

20. A system for stretching and tuning a drumhead of a drum including a drum shell possessing a hollow region and possessing an outer periphery and including a membrane extending across said hollow region, the system comprising:

a plurality of bolts secured to and arranged about the outer periphery of said shell, each of said plurality of bolts having a threaded shaft portion and at least one associated nut threaded thereon; and means for connecting each of said bolts to said membrane, such that when at least one of said nuts is rotated with respect to said associated shaft, said connecting means causes said membrane to be stretched either tighter or looser across said hollow region.

21. A system according to claim 20 wherein said connecting means includes a flexible, elongate, substantially inextensible member.

* * * * *